US011622636B2

(12) United States Patent
Krim et al.

(10) Patent No.: US 11,622,636 B2
(45) Date of Patent: Apr. 11, 2023

(54) MATTRESS

(71) Applicant: Casper Sleep Inc., New York, NY (US)

(72) Inventors: Philip Krim, New York, NY (US); Neil Parikh, Toms River, NJ (US); Jeff Chapin, Providence, RI (US)

(73) Assignee: Casper Sleep Inc., New York, NY (US)

( * ) Notice: Subject to any disclaimer, the term of this patent is extended or adjusted under 35 U.S.C. 154(b) by 0 days.

(21) Appl. No.: 17/457,437

(22) Filed: Dec. 3, 2021

(65) Prior Publication Data

US 2022/0087443 A1 Mar. 24, 2022

Related U.S. Application Data

(63) Continuation of application No. 15/872,737, filed on Jan. 16, 2018, now Pat. No. 11,202,517, which is a (Continued)

(51) Int. Cl.

| | |
|---|---|
| ***A47C 27/15*** | (2006.01) |
| ***A47C 27/14*** | (2006.01) |
| ***A47C 31/10*** | (2006.01) |
| ***A47C 21/04*** | (2006.01) |
| ***A47C 31/08*** | (2006.01) |

(52) U.S. Cl.

CPC ..... *A47C 27/15* (2013.01); *A47C 21/046* (2013.01); *A47C 27/148* (2013.01); *A47C 31/08* (2013.01); *A47C 31/105* (2013.01)

(58) Field of Classification Search

CPC ..... A47C 27/15; A47C 21/046; A47C 27/148; A47C 31/08; A47C 31/105

See application file for complete search history.

(56) References Cited

U.S. PATENT DOCUMENTS

| | | | |
|---|---|---|---|
| D107,880 | S | 1/1938 | Marsack |
| 2,399,625 | A | 5/1946 | Coffman |

(Continued)

FOREIGN PATENT DOCUMENTS

| | | | |
|---|---|---|---|
| CA | 2044355 | C | 1/1995 |
| CA | 2054349 | C | 3/1995 |

(Continued)

OTHER PUBLICATIONS

Communication from Thomas Petr received in PCT/US2015/026564, dated Feb. 27, 2016. (1 page).

(Continued)

*Primary Examiner* — Fredrick C Conley

(74) *Attorney, Agent, or Firm* — Koffsky Schwalb LLC

(57) ABSTRACT

A foam mattress in which a layer of latex or latex-like foam placed above a layer of memory foam is described. This construction of the mattress provides the contouring pressure relief that a visco-elastic foam provides with a top surface with quick recovery (a latex-like "bounce") that prevents people from getting "stuck" in the visco-elastic foam and improves the springiness of the mattress. The mattress may also include straps and cinches to aid in transportation of the mattress. The mattress may also include removable covers that aid in keeping the mattress clean.

6 Claims, 10 Drawing Sheets

Related U.S. Application Data continuation of application No. 15/482,777, filed on Apr. 9, 2017, now abandoned, which is a continuation of application No. 15/080,582, filed on Mar. 24, 2016, now Pat. No. 9,661,934, which is a continuation of application No. 14/689,945, filed on Apr. 17, 2015, now Pat. No. 9,888,785.

(60) Provisional application No. 61/982,235, filed on Apr. 21, 2014.

(56) References Cited

U.S. PATENT DOCUMENTS 4,407,031 A 10/1983 Michiels
4,536,906 A 8/1985 Varndell
4,542,547 A 9/1985 Sato
4,628,557 A 12/1986 Murphy
4,768,251 A 9/1988 Baskent
4,788,730 A 12/1988 Bexton
5,023,967 A 6/1991 Ferrand
5,107,558 A 4/1992 Werner
5,170,522 A 12/1992 Walker
5,189,747 A 3/1993 Mundy
5,219,307 A 6/1993 Morrison
5,291,625 A 3/1994 Leslie
5,294,181 A 3/1994 Rose
5,448,788 A 9/1995 Wu
5,509,154 A 4/1996 Shafer
5,561,876 A 10/1996 Petruzella
5,564,140 A 10/1996 Shoenhair
5,642,546 A 7/1997 Shoenhair
5,652,484 A 7/1997 Shafer
5,730,120 A 3/1998 Yonkers, Jr.
5,765,246 A 6/1998 Shoenhair
5,903,941 A 5/1999 Shafer
5,904,172 A 5/1999 Gifft
6,037,723 A 3/2000 Shafer
6,061,856 A 5/2000 Hoffmann
6,108,843 A 8/2000 Suzuki
6,115,861 A 9/2000 Reeder
6,175,980 B1 1/2001 Gaither
6,192,538 B1 2/2001 Fogel
6,196,157 B1 3/2001 Northrop
6,202,239 B1 3/2001 Ward
6,212,718 B1 4/2001 Stolpmann
6,286,167 B1 9/2001 Stolpmann
6,305,317 B1 10/2001 Spiegel
6,336,237 B1 1/2002 Schmid
6,372,812 B1 * 4/2002 Niederoest ..... B29C 44/3403 521/137
6,397,419 B1 6/2002 Mechache
6,421,859 B1 7/2002 Hicks
6,483,264 B1 11/2002 Shafer
6,546,576 B1 4/2003 Lin
6,557,198 B1 5/2003 Gladney
6,658,683 B2 12/2003 Parvin
D486,877 S 2/2004 Peterson
6,686,711 B2 2/2004 Rose
6,708,357 B2 3/2004 Gaboury
6,763,541 B2 7/2004 Mahoney
6,804,848 B1 10/2004 Rose
6,807,698 B2 10/2004 Torbet
6,832,397 B2 12/2004 Gaboury
6,854,143 B2 2/2005 Sharples
6,883,191 B2 4/2005 Gaboury
6,895,620 B1 5/2005 Rensink
6,931,685 B2 8/2005 Kuchel
6,952,850 B2 10/2005 Visser
6,983,500 B2 1/2006 Wootten
7,036,172 B2 5/2006 Torbet
7,036,173 B2 5/2006 Gladney
7,103,933 B2 9/2006 Gladney
7,147,538 B2 12/2006 Cano
7,155,766 B1 1/2007 Gilchrest, Jr.
7,165,281 B2 1/2007 Larssson
D564,239 S 3/2008 Mecchi
D593,349 S 6/2009 Pittman
7,614,362 B2 11/2009 Dunn
D608,561 S 1/2010 Chen
D634,148 S 3/2011 Morrison
7,908,687 B2 3/2011 Ward
7,914,611 B2 3/2011 Vrzalik
7,921,807 B2 4/2011 Arvanites
7,937,789 B2 5/2011 Feher
7,950,084 B1 5/2011 McKay
D639,492 S 6/2011 Lee
8,065,763 B2 11/2011 Brykalski
8,118,920 B2 2/2012 Vrzalik
8,181,290 B2 5/2012 Brykalski
8,245,339 B2 8/2012 Murray
8,256,236 B2 9/2012 Lofy
8,307,482 B2 11/2012 Gladney
8,336,369 B2 12/2012 Mahoney
8,372,182 B2 2/2013 Vrzalik
8,402,578 B2 3/2013 Ko
8,448,315 B2 5/2013 Rensink
8,490,233 B2 7/2013 Essers
8,512,854 B2 8/2013 Fox
8,621,687 B2 1/2014 Brykalski
8,672,842 B2 3/2014 Kenalty
8,739,339 B1 6/2014 McKay
8,745,784 B2 6/2014 Cole
8,745,795 B2 6/2014 Klancnik
8,769,747 B2 7/2014 Mahoney
8,789,224 B2 7/2014 Wyatt
8,800,979 B2 8/2014 Defranks
D713,165 S 9/2014 Robinson
8,832,888 B2 9/2014 Chunglo
8,863,336 B2 10/2014 Theosabrata
8,881,328 B2 11/2014 Mikkelsen
8,918,930 B2 12/2014 Stroh
8,931,329 B2 1/2015 Mahoney
8,933,140 B2 1/2015 Peterson
D722,239 S 2/2015 Russell
8,966,689 B2 3/2015 McGuire
8,973,183 B1 3/2015 Palashewski
8,984,687 B2 3/2015 Stusynski
8,984,690 B2 3/2015 Chunglo
8,997,279 B1 4/2015 McKay
9,009,898 B2 4/2015 Morimura
D728,254 S 5/2015 Karnes-Toth
9,085,125 B2 7/2015 Gesquière
9,095,224 B2 8/2015 Tanaka
9,119,478 B2 9/2015 Defranks
9,125,497 B2 9/2015 Brykalski
9,138,064 B2 9/2015 Tursi, Jr.
9,186,479 B1 11/2015 Franceschetti
9,192,245 B2 11/2015 Chunglo
9,204,731 B2 12/2015 Corodemus
9,204,732 B2 12/2015 Wyatt
9,211,017 B2 12/2015 Tyree
9,259,099 B1 2/2016 Larsen
9,265,352 B2 2/2016 Oakhill
9,271,579 B2 3/2016 Riley
9,326,903 B2 5/2016 Locke
9,326,904 B2 5/2016 Nomura
9,370,457 B2 6/2016 Nunn
9,386,862 B1 7/2016 Limer
9,392,875 B2 7/2016 Weyl
9,392,879 B2 7/2016 Nunn
D766,017 S 9/2016 Jensen
9,445,751 B2 9/2016 Young
9,474,384 B2 10/2016 Rawls-Meehan
D770,672 S 11/2016 Ju
9,504,332 B2 11/2016 Gladney
D773,209 S 12/2016 Jaigobin
9,510,688 B2 12/2016 Nunn
9,510,698 B1 12/2016 Krotova
D776,960 S 1/2017 Suzuki
9,538,853 B2 1/2017 Vrzalik
9,538,855 B2 1/2017 Gross
9,578,941 B2 2/2017 Maclachlan
9,597,244 B2 3/2017 Ishibashi
9,609,951 B2 4/2017 Chan

(56) References Cited

U.S. PATENT DOCUMENTS 9,622,589 B2 4/2017 Nomura
9,635,953 B2 5/2017 Nunn
9,642,472 B2 5/2017 Gladney
9,657,800 B2 5/2017 Defranks
9,694,156 B2 7/2017 Franceschetti
9,730,524 B2 8/2017 Chen
9,737,150 B2 8/2017 Rawls-Meehan
9,737,154 B2 8/2017 Mahoney
D798,077 S 9/2017 Schmitt
9,770,114 B2 9/2017 Brosnan
9,770,117 B1 9/2017 Torbet
D799,858 S 10/2017 Pearce
9,782,311 B2 10/2017 Lafleche
D804,856 S 12/2017 Desodt
9,844,275 B2 12/2017 Nunn
9,861,208 B2 1/2018 Carlitz
9,888,782 B1 2/2018 Jannke
D812,393 S 3/2018 Karschnik
9,907,408 B2 3/2018 Vrzalik
9,918,558 B2 3/2018 Limer
9,930,971 B2 4/2018 Dóczi
9,931,085 B2 4/2018 Young
9,949,573 B1 4/2018 Huang
9,962,902 B2 5/2018 Losio
10,016,064 B2 7/2018 Corodemus
D824,698 S 8/2018 Pennington
10,051,973 B2 8/2018 Morgan
10,058,467 B2 8/2018 Stusynski
10,092,242 B2 10/2018 Nunn
10,105,092 B2 10/2018 Franceschetti
10,136,735 B2 11/2018 Ocegueda
10,143,312 B2 12/2018 Brosnan
10,149,549 B2 12/2018 Erko
10,154,932 B2 12/2018 Franceschetti
10,179,526 B2 1/2019 Marquette
10,182,661 B2 1/2019 Nunn
D840,732 S 2/2019 Karschnik
10,194,752 B2 2/2019 Zaiss
10,194,753 B2 2/2019 Fleury
10,201,234 B2 2/2019 Nunn
10,202,499 B2 2/2019 Crawford
10,251,490 B2 4/2019 Nunn
D848,051 S 5/2019 Huang
10,285,508 B2 5/2019 Rose
D850,161 S 6/2019 Ping
10,314,407 B1 6/2019 Main
10,342,358 B1 7/2019 Palashewski
10,357,113 B2 7/2019 Gladney
10,357,115 B2 7/2019 Oh
D864,615 S 10/2019 Morrison
10,441,086 B2 10/2019 Nunn
10,441,087 B2 10/2019 Karschnik
10,448,749 B2 10/2019 Palashewski
D865,402 S 11/2019 Morrison
10,463,165 B2 11/2019 Ishibashi
10,470,583 B2 11/2019 Gross
10,477,975 B2 11/2019 Tursi, Jr.
10,492,969 B2 12/2019 Stusynski
10,531,745 B2 1/2020 Chen
10,539,170 B2 1/2020 Griffith
2001/0027334 A1 10/2001 White
2001/0029628 A1 10/2001 Ferrand
2002/0069462 A1 6/2002 Gaboury
2003/0181538 A1 9/2003 Martel
2003/0233706 A1 12/2003 Birch
2004/0134433 A1 7/2004 Holder
2005/0210595 A1 9/2005 Di Stasio
2006/0042008 A1 3/2006 Baker
2006/0053560 A1 3/2006 Metzger
2006/0053561 A1 3/2006 Metzger
2006/0085919 A1 4/2006 Kramer
2007/0040424 A1 2/2007 Neustat
2007/0107133 A1 5/2007 Schwaiger
2007/0226911 A1 10/2007 Gladney
2008/0010751 A1 1/2008 Kemper
2008/0028536 A1 2/2008 Hadden-Cook
2008/0052830 A1 3/2008 Koughan
2008/0116403 A1 5/2008 Shelbourn
2008/0155755 A1 7/2008 Crousore
2008/0201856 A1 8/2008 Howard
2008/0313815 A1* 12/2008 Guesquiere ..... B32B 3/266 428/141
2009/0000031 A1 1/2009 Feher
2009/0089933 A1 4/2009 Letton
2009/0106894 A1 4/2009 Yeo
2009/0127912 A1 5/2009 Galbreath
2009/0151072 A1 6/2009 Jones, III
2009/0172881 A1 7/2009 Peterson
2009/0217459 A1 9/2009 Rudolph
2010/0038882 A1 2/2010 Chimento
2010/0058541 A1 3/2010 Kemper
2010/0087561 A1 4/2010 Abraham
2010/0160473 A1 6/2010 Neff
2010/0237082 A1 9/2010 Fernandez
2010/0269262 A1 10/2010 Warren
2011/0035879 A1 2/2011 Grinstead
2011/0061168 A1 3/2011 Farley
2011/0067183 A1* 3/2011 Hawkins ..... B32B 7/12 156/60
2011/0099722 A1 5/2011 Moret
2011/0107514 A1 5/2011 Brykalski
2011/0115635 A1 5/2011 Petrovski
2011/0154576 A1 6/2011 Warren
2011/0173757 A1 7/2011 Rensink
2011/0252572 A1* 10/2011 Morrison ..... A47C 27/15 5/740
2012/0053423 A1 3/2012 Kenalty
2012/0060284 A1 3/2012 Caines
2012/0110734 A1 5/2012 An
2012/0159715 A1 6/2012 Jung
2012/0180225 A1 7/2012 Gladney
2013/0025050 A1 1/2013 Syrowitz
2013/0025070 A1 1/2013 Ruehlmann
2013/0146211 A1 6/2013 Mason
2013/0152305 A1 6/2013 Lall
2013/0174344 A1 7/2013 Klancnik
2013/0175057 A1 7/2013 Klancnik
2013/0180050 A1 7/2013 Koci
2013/0247828 A1 9/2013 Tedaldi
2013/0263377 A1 10/2013 Wootten, Jr.
2013/0263386 A1 10/2013 Romero
2013/0284099 A1 10/2013 Oakes, Jr.
2014/0033440 A1 2/2014 Tyree
2014/0033441 A1 2/2014 Morgan
2014/0039082 A1 2/2014 Peterson
2014/0068868 A1 3/2014 Morzano
2014/0082843 A1 3/2014 Papadakos
2014/0109314 A1 4/2014 Boersma
2014/0109320 A1 4/2014 Chunglo
2014/0141233 A1 5/2014 Crawford
2014/0182061 A1 7/2014 Zaiss
2014/0190417 A1 7/2014 Lipscomb
2014/0201925 A1 7/2014 Tursi, Jr.
2014/0208517 A1 7/2014 Gross
2014/0227552 A1 8/2014 Lau
2014/0230735 A1 8/2014 Coulter
2014/0259433 A1 9/2014 Nunn
2014/0277822 A1 9/2014 Nunn
2014/0283308 A1 9/2014 Chen
2015/0007393 A1 1/2015 Palashewski
2015/0026896 A1 1/2015 Fleury
2015/0067967 A1 3/2015 Tyree
2015/0074911 A1 3/2015 Dungan
2015/0082545 A1 3/2015 Holbrook
2015/0113737 A1* 4/2015 Davis ..... A47C 27/15 5/690
2015/0182032 A1 7/2015 Jensen
2015/0182397 A1 7/2015 Palashewski
2015/0182399 A1 7/2015 Rose
2015/0208819 A1 7/2015 McKay
2015/0290059 A1 10/2015 Brosnan
2015/0296995 A1 10/2015 Krim
2015/0351556 A1 12/2015 Franceschetti
2015/0351982 A1 12/2015 Krenik

(56) References Cited

U.S. PATENT DOCUMENTS

| | | | |
|---|---|---|---|
| 2015/0366366 | A1 | 12/2015 | Zaiss |
| 2016/0015184 | A1 | 1/2016 | Nunn |
| 2016/0037938 | A1 | 2/2016 | Tyree |
| 2016/0073788 | A1 | 3/2016 | Franceschetti |
| 2016/0073950 | A1 | 3/2016 | Franceschetti |
| 2016/0081487 | A1 | 3/2016 | Corodemus |
| 2016/0100696 | A1 | 4/2016 | Palashewski |
| 2016/0128487 | A1 | 5/2016 | Eskridge, III |
| 2016/0128488 | A1 | 5/2016 | Franceschetti |
| 2016/0157625 | A1 | 6/2016 | Schneider |
| 2016/0183691 | A1 | 6/2016 | Mason |
| 2016/0192617 | A1 | 7/2016 | Murphy |
| 2016/0192786 | A1 | 7/2016 | Holbrook |
| 2016/0242562 | A1 | 8/2016 | Karschnik |
| 2016/0296031 | A1 | 10/2016 | Sramek |
| 2016/0338871 | A1 | 11/2016 | Nunn |
| 2017/0003666 | A1 | 1/2017 | Nunn |
| 2017/0028165 | A1 | 2/2017 | Franceschetti |
| 2017/0035212 | A1 | 2/2017 | Erko |
| 2017/0112292 | A1 | 4/2017 | Sopher |
| 2017/0135632 | A1 | 5/2017 | Franceschetti |
| 2017/0135883 | A1 | 5/2017 | Franceschetti |
| 2017/0196369 | A1 | 7/2017 | Nunn |
| 2017/0231401 | A1 | 8/2017 | McGuire |
| 2017/0259028 | A1 | 9/2017 | Franceschetti |
| 2017/0273470 | A1 | 9/2017 | Brykalski |
| 2017/0295945 | A1 | 10/2017 | Stickler |
| 2017/0296412 | A1 | 10/2017 | Hung |
| 2017/0296773 | A1 | 10/2017 | Franceschetti |
| 2017/0318980 | A1 | 11/2017 | Mahoney |
| 2017/0318981 | A1 | 11/2017 | Duwell |
| 2017/0348182 | A1 | 12/2017 | Yoo |
| 2017/0354268 | A1 | 12/2017 | Brosnan |
| 2018/0027981 | A1 | 2/2018 | Sherman |
| 2018/0042393 | A1 | 2/2018 | Alletto |
| 2018/0100254 | A1 | 4/2018 | Brunton |
| 2018/0116415 | A1 | 5/2018 | Karschnik |
| 2018/0125259 | A1 | 5/2018 | Peterson |
| 2018/0125260 | A1 | 5/2018 | Peterson |
| 2018/0153766 | A1 | 6/2018 | Chen |
| 2018/0271300 | A1 | 9/2018 | Wang |
| 2018/0289171 | A1 | 10/2018 | Alletto, Jr. |
| 2019/0021513 | A1 | 1/2019 | Nunn |
| 2019/0029597 | A1 | 1/2019 | Nunn |
| 2019/0082855 | A1 | 3/2019 | Brosnan |
| 2019/0104858 | A1 | 4/2019 | Erko |
| 2019/0125097 | A1 | 5/2019 | Nunn |
| 2019/0133332 | A1 | 5/2019 | Zaiss |
| 2019/0174930 | A1 | 6/2019 | Defranks |
| 2019/0186704 | A1 | 6/2019 | Qiu |
| 2019/0231084 | A1 | 8/2019 | Nunn |
| 2019/0254438 | A1 | 8/2019 | Rose |
| 2019/0254593 | A1 | 8/2019 | Franceschetti |
| 2019/0269878 | A1 | 9/2019 | Franceschetti |
| 2019/0320809 | A1 | 10/2019 | Ishibashi |
| 2019/0321581 | A1 | 10/2019 | Franceschetti |
| 2019/0328147 | A1 | 10/2019 | Palashewski |
| 2019/0357696 | A1 | 11/2019 | Palashewski |
| 2019/0376945 | A1 | 12/2019 | Yao |
| 2020/0029704 | A1 | 1/2020 | Karschnik |
| 2020/0113343 | A1 | 4/2020 | Staels |

FOREIGN PATENT DOCUMENTS

| | | | |
|---|---|---|---|
| CA | 2112895 | C | 8/1998 |
| CA | 2305522 | A1 | 4/1999 |
| CA | 2416861 | A1 | 8/2003 |
| CA | 2502697 | A1 | 4/2004 |
| CA | 2525570 | C | 11/2006 |
| CA | 2650218 | A1 | 11/2007 |
| CA | 2922187 | A1 | 11/2007 |
| CA | 2989606 | A1 | 3/2010 |
| CA | 2754914 | A1 | 9/2010 |
| CA | 2618630 | C | 10/2011 |
| CA | 2799927 | A1 | 12/2011 |
| CA | 2801789 | A1 | 12/2011 |
| CA | 2823387 | A1 | 7/2012 |
| CA | 2783753 | A1 | 1/2013 |
| CA | 2783982 | A1 | 1/2013 |
| CA | 2843370 | A1 | 1/2013 |
| CA | 2848770 | A1 | 3/2013 |
| CA | 2855227 | A1 | 4/2013 |
| CA | 2651960 | C | 7/2013 |
| CA | 2800552 | A1 | 7/2013 |
| CA | 2878994 | A1 | 3/2014 |
| CA | 2888119 | A1 | 5/2014 |
| CA | 2894194 | A1 | 6/2014 |
| CA | 2839603 | A1 | 7/2014 |
| CA | 2648272 | C | 1/2015 |
| CA | 2863889 | A1 | 3/2015 |
| CA | 2922738 | A1 | 3/2015 |
| CA | 2937238 | A1 | 7/2015 |
| CA | 2963626 | A1 | 4/2016 |
| CA | 2744772 | C | 5/2016 |
| CA | 2876788 | A1 | 7/2016 |
| CA | 2978341 | A1 | 10/2016 |
| CA | 2956830 | A1 | 8/2017 |
| CA | 2958348 | A1 | 8/2017 |
| CA | 2940763 | C | 10/2017 |
| CA | 2740802 | C | 1/2018 |
| CA | 2770105 | C | 1/2018 |
| CA | 2737749 | C | 2/2018 |
| CN | 2071915 | U | 2/1991 |
| CN | 2633118 | Y | 8/2004 |
| CN | 2636734 | Y | 9/2004 |
| CN | 2840811 | Y | 11/2006 |
| CN | 101138457 | A | 3/2008 |
| CN | 201341650 | Y | 11/2009 |
| CN | 201379320 | | 1/2010 |
| CN | 201452382 | U | 5/2010 |
| CN | 201727183 | U | 2/2011 |
| CN | 201996026 | U | 10/2011 |
| CN | 202014890 | U | 10/2011 |
| CN | 202136017 | U | 2/2012 |
| CN | 102822224 | | 12/2012 |
| CN | 202604242 | U | 12/2012 |
| CN | 203016383 | U | 6/2013 |
| CN | 203328338 | | 12/2013 |
| CN | 105640152 | | 6/2016 |
| CN | 205548120 | U | 9/2016 |
| CN | 106617913 | A | 5/2017 |
| CN | 107307672 | A | 11/2017 |
| CN | 107432611 | A | 12/2017 |
| CN | 107455989 | A | 12/2017 |
| DE | 7037476 | U | 5/1971 |
| DE | 2708068 | A1 | 9/1978 |
| DE | 10238457 | A1 | 3/2004 |
| DE | 10300169 | A1 | 7/2004 |
| DE | 202005016938 | U1 | 3/2007 |
| DE | 102007021312 | A1 | 11/2008 |
| DE | 102009044308 | A1 | 4/2011 |
| DE | 202010017223 | U1 | 8/2011 |
| DE | 102008055549 | B4 | 7/2014 |
| DE | 102010048357 | B4 | 2/2017 |
| DE | 112015005896 | T5 | 9/2017 |
| EP | 1011391 | B1 | 10/2002 |
| EP | 1457139 | A1 | 9/2004 |
| EP | 1670338 | A1 | 6/2006 |
| EP | 1951089 | A2 | 8/2008 |
| EP | 1793707 | B1 | 10/2008 |
| EP | 1339369 | B1 | 1/2010 |
| EP | 2140847 | A2 | 1/2010 |
| EP | 1648269 | B1 | 11/2010 |
| EP | 2263498 | A2 | 12/2010 |
| EP | 2280627 | B1 | 10/2011 |
| EP | 2341800 | B1 | 11/2012 |
| EP | 2532278 | A1 | 12/2012 |
| EP | 2532281 | A1 | 12/2012 |
| EP | 2393399 | B1 | 3/2013 |
| EP | 2764799 | A2 | 8/2014 |
| EP | 1261265 | B1 | 7/2015 |
| EP | 2957191 | A1 | 12/2015 |
| EP | 2369959 | B1 | 8/2016 |
| ES | 2201183 | T3 | 3/2004 |

(56) References Cited

FOREIGN PATENT DOCUMENTS

| | | | |
|---|---|---|---|
| ES | 2534286 | T3 | 4/2015 |
| ES | 2535762 | R1 | 6/2015 |
| ES | 2535762 | B1 | 4/2016 |
| FR | 2473291 | | 7/1981 |
| FR | 2622683 | A1 | 5/1989 |
| FR | 2641455 | A1 | 7/1990 |
| FR | 2759304 | A1 | 8/1998 |
| FR | 2835164 | A3 | 8/2003 |
| GB | 2458892 | B | 11/2012 |
| JP | H05123231 | A | 5/1993 |
| JP | H05146345 | A | 6/1993 |
| JP | 2002253388 | A | 9/2002 |
| JP | 2004329706 | | 11/2004 |
| JP | 2005000192 | | 1/2005 |
| JP | 2005160794 | A | 6/2005 |
| JP | 2014023967 | A | 2/2014 |
| JP | 6383771 | | 8/2018 |
| KR | 20110132025 | A | 12/2011 |
| KR | 101465852 | B1 | 11/2014 |
| KR | 101581722 | B1 | 1/2016 |
| KR | 20180031449 | A | 3/2018 |
| RU | 2607426 | C1 | 1/2017 |
| WO | 2000002516 | A1 | 1/2000 |
| WO | 2005032310 | | 4/2005 |
| WO | 2007060371 | A2 | 5/2007 |
| WO | 2013157534 | | 10/2013 |
| WO | 2014105687 | | 7/2014 |
| WO | 2016182795 | A1 | 11/2016 |
| WO | 2016182858 | A1 | 11/2016 |
| WO | 2017213732 | A1 | 12/2017 |
| WO | 2018089464 | A1 | 5/2018 |

OTHER PUBLICATIONS

Corrected Notice of Allowability dated Aug. 26, 2020 for U.S. Appl. No. 29/610,852 (pp. 1-4).
Correspondence Regarding Distribution of Dormia Radiance Mattress, Authored by Classic Brands, LLC, dated Nov. 1, 2007. (1 pg).
Design Within Reach, Min Bed, http://www.dwr.com/bedroom-beds/min-bed/6348.html?lang=en_US) (accessed May 23, 2018) (19 pages).
Dormia Website Existing at Least as Early as Jun. 14, 2008. (2 pages).
Extended European Search Report issued in EP18192998.5, dated Nov. 20, 2018, 8 pages.
Frontgate Huggy Nest Pet Bed, accessed Sep. 16, 2016 (http://www.frontgate.com/huggy-nest-pet-bed/pet-products/pet-bedsblankets-throws/bolster-pet-beds/802099), (2 pages).
How to set up your dog mattress, no date available (1 page).
Howlpot My Territory, accessed Sep. 16, 2016. (http://www.howlpot.com/product/detail.html?product_no=30&cate_no=1&displ- ay_group=2) (9 pages).
International Search Report and Written Opinion for App. No. PCT/US2020/043712, dated Oct. 14, 2020, 17 pages.
International Search Report and Written Opinion for Application No. PCT/US19/28543, dated Aug. 22, 2019, 16 pages.
International Search Report and Written Opinion for PCT/US18/46573 dated Oct. 22, 2018, 23 pages.
International Search Report, Written Opinion of ISA and Search History, PCT/US2015/026564, dated Aug. 31, 2015. (19 pages).
International Search Report, Written Opinion of ISA, PCT/US2019/12582 (dated Apr. 25, 2019) (14 pages).
Japanese Office Action (with English language translation) for Application No. 2017-507687, dated Apr. 2, 2019, 9 pages.
Jax & Bones Donut Bed, accessed Sep. 16, 2016 (https://www.jaxandbones.com/products/bedding/donut/licorice-donut-bed) (3 pages).
Jax & Bones Memory Foam Bed, accessed Sep. 16, 2016 (https://www.jaxandbones.com/products/bedding/memory-foam/juniper-memory-foam-pillow) (2 pages).
Lux Premium Dog Bed, accessed Sep. 16, 2016 (http://godogbeds.com/product/sample-product-2/) (1 page).
Notice of Allowability dated Dec. 9, 2020 for U.S. Appl. No. 29/703,367 (pp. 1-3).
Office Action and Search Report for China Patent Application No. 201580019495.5 (May 3, 2018) (12 pages).
Office Action dated Dec. 15, 2020 for U.S. Appl. No. 16/102,649 (pp. 1-17).
Office Action dated May 6, 2020 for U.S. Appl. No. 15/872,737 (pp. 1-10).
Office Action dated Oct. 15, 2020 for U.S. Appl. No. 16/390,194 (pp. 1-24).
Organic Wool Toddler Pillow, All Natural &100% GOTS Certified Pure Organic, Wool 'Pearls' accessed Jul. 13, 2017 (https://www.amazon.com/Organic-Certified-Antibacterial-Hypoallergenic-Toddlers/dp/B00P6SKT7K) (2 pages).
Orvis Tempur-Pedic.RTM. Deep Dish Dog Bed, accessed Sep. 16, 2016. (http://www.orvis.com/p/orvis-tempur-pedic-deepdish-dog-bed/2gr6) (2 pages).
Orvis ToughChew Dog Bed with Polyester Fill, accessed Sep. 16, 2016 (http://www.orvis.com/p/toughchew-rectangle-dogbed/0h4c) (2 pages).
Specification and Build Sheet for Dormia Radiance Mattress dated Jun. 14, 2007. (2 pages).
Supplementary Partial European Search Report for EP 15 78 3835 (Nov. 14, 2017) (14 pages).
The Casper Mattress, casper.com/mattresses/casper/, retrieved Aug. 27, 2019, 29 pages.
The Essential Mattress, casper.com/mattresses/casper-essential/, retrieved Aug. 27, 2019, 15 pages.
The Wave Mattress, casper.com/mattresses/casper-wave/, retrieved Aug. 27, 2019, 30 pages.
Third-Party Submission Under 37 CFR 1.290 dated Jun. 14, 2016 in U.S. Appl. No. 14/689,945. (15 pages).
Third-Party Submission Under 37 CFR 1.290 dated Jun. 27, 2016 in U.S. Appl. No. 14/689,945. (11 pages).
Third-Party Submission under 37 CFR 1.290 mailed on Jun. 10, 2016 in U.S. Appl. No. 14/689,945. (9 pages).

* cited by examiner

MATTRESS

RELATED APPLICATIONS

This application claims the benefit of the U.S. Provisional Patent Application Ser. No. 61/982,235 filed on Apr. 21, 2014.

FIELD OF THE DISCLOSURE

The present disclosure is directed to a foam mattress with improved features related to its construction, transportation and cleaning.

BACKGROUND

Although the traditional spring mattress is the dominant category of mattresses sold within the United States, both latex foam mattresses and visco-elastic (memory) foam mattresses have been sold in the U.S. as specialty-category mattresses.

Both latex and memory foams have benefits and drawbacks in mattress construction and design. Latex foam has a very quick recovery rate (i.e., is "bouncy"), is highly breathable and can be produced using natural or synthetic materials. If natural materials are used, the mattress can be marketed as such, adding to its desirability in the marketplace. Nonetheless, latex foam mattresses have the highest average return rate of any type of mattress sold in the U.S.—usually due to the resonant "bouncing" that the user feels on a latex foam mattress and/or inadequate pressure relief.

The market for memory foam mattresses was built nearly single-handedly by Tempur-Pedic through novel marketing techniques, such as an association with space-age technology and the image of a handprint "stuck" in the foam top layer after the hand is removed. Due to its slow recovery (or memory), visco-elastic memory foam was marketed as an aid for pressure relief and to enable isolation of one sleeper from another because the foam does not translate vibration. But memory foam mattresses also have a somewhat high return rate, often due to complaints such as: 1) "getting stuck" (i.e., not being able to turn over when changing sleeping positions); 2) overheating (the foam is not highly breathable and the contouring causes the foam to closely hug large portions of the body limiting air flow); and 3) not being conducive for comfort during sex because of the tendency to "get stuck."

Further, both latex and memory foam are expensive materials. Manufacturers often use them only for the top layer(s) of a mattress, often referred to as the comfort layer(s). The comfort layer(s) are usually 1-5" thick and typically consist of 1-3 different foam types laminated together. Beneath these layer(s), regular polyurethane foam is typically used to provide some support and to increase mattress thickness. Some newer "hybrid" mattresses use pocketed spring coils instead of polyurethane foam. To combat the "stuck" feeling of memory foam, some manufacturers have developed quick-response memory foam. Other manufacturers use thinner layers of memory foam (atop poly foam) to limit the depth that user can sink into the foam. A few manufacturers have put latex foam underneath the memory foam to benefit from the quick return (i.e. bounce) that the latex foam provides. But this solution may not solve the problems noted above where memory foam is the top layer of the mattress.

Accordingly, there is a need for a novel foam mattress construction that couples the contouring pressure relief of memory foam with quick-recovery of latex foam that prevents users from getting "stuck" in the memory foam and improves the springiness of the mattress. Such an arrangement will benefit from the breathability and bounciness of latex foam while mitigating the resonant bouncing and poorer pressure relief characteristics of latex foam.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
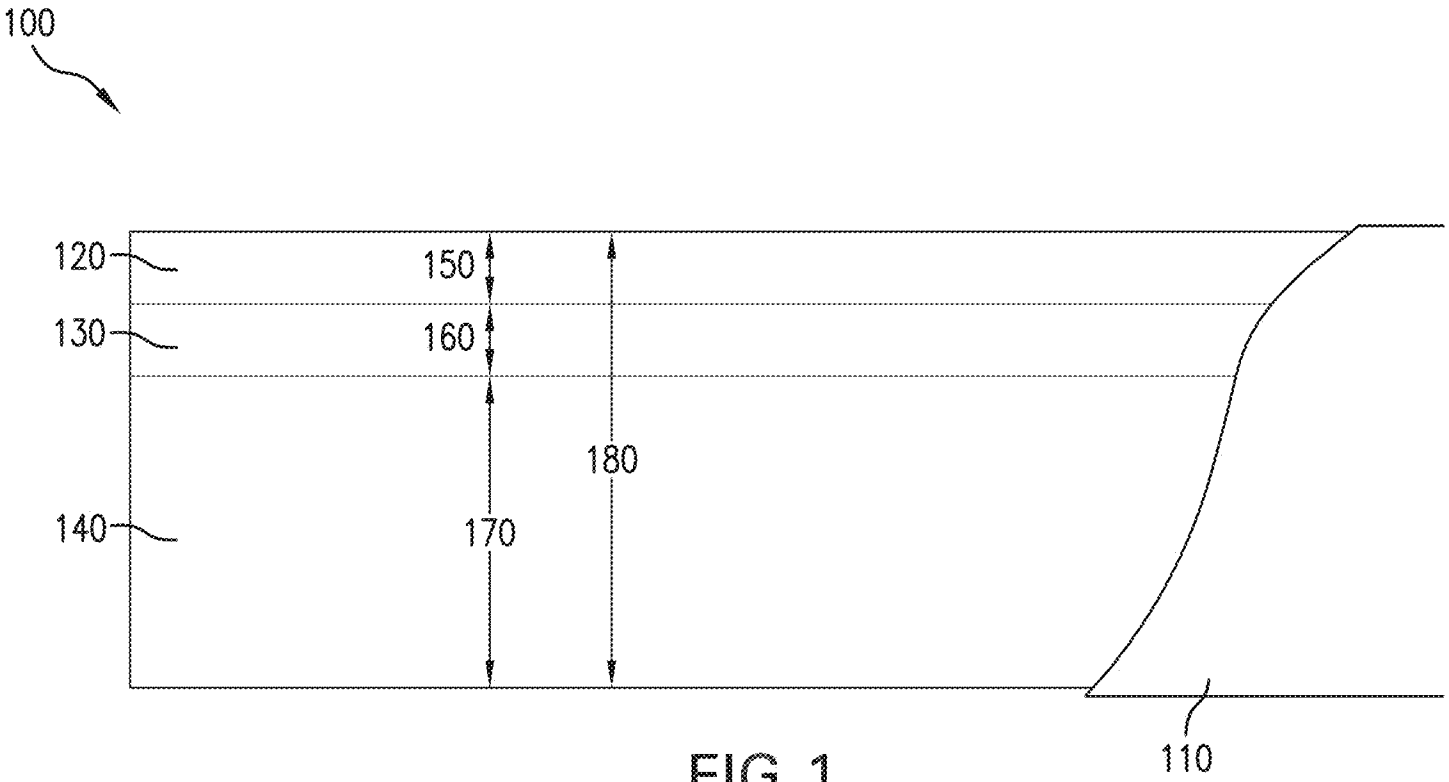
FIG. 1 is a cross-section view of a three-layer mattress in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

I. Definitions

In this disclosure, the listed terms will be defined as follows:

Density of a foam is its mass per unit volume. Density may be measured in pounds per cubic foot (pcf).

IFD is Indentation Force Deflection, which is a method for determining the firmness, and load bearing capacity of foam. IFD measures the load required to depress a 50 square inch compression platen into a foam specimen. IFD is usually reported at 25% deflection of the specimen's height and is measured in pounds. IFD may be measured with ASTM D3574-11 Test $B_1$.

Airflow is a measure of the air permeability of a foam and is measured in cubic feet per minute (cfm). Airflow may be measured with ASTM D3574-11 Test G.

Recovery is a measure of how quickly a foam returns to original shape after being displaced and is measured in seconds. Recovery is typically used to measure the memory effect of visco-elastic foams. Recovery may be measured with ASTM D3574-11 Test M.

Rebound is measure of the elasticity of a foam and is measured as a percentage. A steel ball is dropped on a foam specimen, and the percentage height it rebounds (relative to drop height) is measured. Rebound may be measured with ASTM D3574-11 Test H Support Factor (SF) is the ratio of 65% IFD over 25% IFD and is a unitless measurement. SF is a measure of the "deeper" support of a foam, and is an indicator as to whether a foam will bottom out or not. SF may be measured with ASTM D3574-11 Test $B_1$.

Tg is the glass transition temperature of the foam. It is a property of all foams but is most relevant with memory foams because memory foams have a Tg within the range of normal ambient temperature (40° F.-80° F.). Tg is the point at which a foam transitions from stiff to pliable. Below Tg, a foam is stiff. Above Tg, a foam is pliable. The transition in mechanical properties can be dramatic, even with but a few degrees change in temperature. Tg, may be measured with dynamic mechanical analysis (DMA) or thermal stress analysis (TSA).

Latex foam is any high resilience foam where: i) a rebound may be greater than 40%; ii) airflow may be greater than 3.5 cfm; and iii) recovery may be less than 0.5 seconds. Latex foam may be natural latex, styrene butadiene rubber (SBR), polyurethane or any blend of the above foams.

Latex-like foam is any foam intended to simulate the mechanical properties of latex foam—(i) a rebound may be greater than 40%; ii) airflow may be greater than 3.5 cfm; and iii) recovery may be less than 0.5 seconds—but with polyurethane, polyethylene or other non-natural or non-SBR resins or any blend of the above foams.

Memory foam is any polyurethane foam with a low rebound, delayed recovery and a temperature-sensitive response. More specifically: i) the rebound may be from 1-2%; ii) the recovery may be greater than 1 second; and iii) the temperature-sensitive response may be the foam softening in response to body heat and having a Tg between 40° F. and 80° F.

II. Mattress Length and Width

The mattresses described herein may be of any suitable length and width, including without limitation U.S. or non-U.S. standard sizes such as King, Queen, Full, Twin, Extra Long, California King, Youth and Crib.

III. The Three-Layer Mattress

Turing to FIG. 1, shown is cross-section of a three-layer mattress 100 with a cover 110. The cross-section of the depth of the mattress 100 includes a first layer 120, a second layer 130 and a third layer 140.

A. First Embodiment

In a first embodiment, the total depth 180 of the mattress 100 may be 9.5 inches. The first layer depth 150 of the mattress 100 may be 1.5 inches. The second layer depth 160 of the mattress may be 1.5 inches. The third layer depth 170 of the mattress may be 6.5 inches.

In this first embodiment, the first layer 120 is a layer of latex foam. The first layer 120 may consist of C1 latex from Mountain Top Foam and may have the physical properties shown in Table 1.

TABLE 1

| | Target | Tolerance | Unit | Test Method | Potential Range | Unit |
|---|---|---|---|---|---|---|
| Density | 3.3 | ±0.2 | pcf | n/a | 2 to 4 | pcf |
| 25% IFD | 12 | ±1 | lb | ASTM D3574-11 Test $B_1$ | 6 to 18 | lb |
| Airflow | >4 | minimum | cfm | ASTM D3574-11 Test G | >2 | cfm |
| Recovery | <0.5 | maximum | seconds | ASTM D3574-11 Test M | <1 | seconds |
| Rebound | 65 | ±5 | % | ASTM D3574-11 Test H | >40 | % |
| Support Factor | 3 | ±0.1 | n/a | ASTM D3574-11 Test $B_1$ | >2 | n/a |
| Tg | | | n/a | | | |

In Table 1, the rightmost two columns demonstrate potential ranges of physical properties related to the first layer 120.

The second layer 130 is a layer of memory foam. The second layer 130 may consist of 4 lb Visco memory foam and may have the physical properties shown in Table 2.

TABLE 2

| | Target | Tolerance | Unit | Test Method | Potential Range | Unit |
|---|---|---|---|---|---|---|
| Density | 4.0 | ±0.1 | pcf | n/a | 2 to 6 | pcf |
| 25% IFD | 10 | ±1 | lb | ASTM D3574-11 Test $B_1$ | 6 to 18 | lb |
| Airflow | >2 | minimum | cfm | ASTM D3574-11 Test G | >1 | cfm |
| Recovery | 3 | ±1 | seconds | ASTM D3574-11 Test M | >1 | seconds |
| Rebound | 2 | maximum | % | ASTM D3574-11 Test H | <5 | % |
| Support Factor | 2.2 | ±0.1 | n/a | ASTM D3574-11 Test $B_1$ | <2.6 | n/a |
| Tg | 60 | ±2 | ° F | DMA | 40 to 80 | ° F |

In Table 2, the rightmost two columns demonstrate potential ranges of physical properties related to the second layer 130.

In the mattress industry, two important parameters used to describe a foam are IFD and SF. Standard test protocols specify the test specimen size and loading regime for these parameters, which creates measurement consistency. Such test protocols may be found in ASTM D3574-11.

IFD is an indication of foam firmness and indicates how much force a foam pushes back with when a user pushes into it. Industry norms use 25% IFD numbers as a basis for comparison—so an IFD 8 foam (8 pounds of push-back) feels softer than a IFD 20 foam (20 pounds of push-back).

SF represents the "deeper" support of a foam, and is an indicator as to whether a foam will bottom out or not. SF is the ratio of the 65% IFD to the 25% IFD—the ratio of the force required to depress a sample to 65% of its original height to the force required to depress a sample to 25% of its original height (the standard IFD measurement). SF illustrates how much a single type of foam pushes back the more the user pushes into it. Thus, a foam with a SF of 3 and an IFD of 8 pushes back with 24 pounds force upon 65% compression, while an IFD 8 foam with a SF of 2 only pushes back with 16 pounds at 65% compression.

A linear "spring" foam generally has a SF of 2.6. Latex and latex-like foam typically have a higher SF (approximately 3.0-3.3). Memory foam typically has a lower SF (approximately 2.0-2.2). These differences are quite significant in the overall feel of the mattress.

In the mattress industry, it has been a widely accepted rule of thumb that the top layers of foam should have the lowest SF to reduce pressure points, and that the SF should increase as one moves down into the layers. By having the first layer 120 being comprised of a latex or latex-like foam and placed on top of the second layer 130 being comprised of memory foam, the commonly-held rule regarding SF is inverted. Nonetheless, a successful experience for the mattress user is achieved because the foam layers of the bed act as a series of springs. This arrangement eliminates the "stuckness" of memory foam while retaining the pressure relief and motion isolation of the memory foam. At the same time, this arrangement benefits from the breathability and bounciness of latex or latex-like foam while mitigating the resonant bouncing and poorer pressure relief characteristics of latex or latex-like foam.

The third layer 140 adds overall support and depth for the mattress and may consist of 1.8 pcf conventional polyurethane foam and may have the physical properties shown in Table 3.

In Table 3, the rightmost two columns demonstrate potential ranges of physical properties related to the third layer 140.

B. The Second Embodiment

In a second embodiment, the total depth 180 of the mattress 100 may range from 1 to 22 inches. The first layer depth 150 of the mattress 100 may range from 0.25 to 5 inches. The second layer depth 160 of the mattress may range from 0.25 inches to 5 inches. The third layer depth 170 of the mattress may range from 0.5 to 12 inches.

The second embodiment is similar to the first embodiment in that the first layer 120 is latex or latex-like foam and the second layer 130 is memory foam. The third layer 140 may be any of the following: i) latex foam; ii) latex-like foam; iii) polyurethane visco-elastic "memory" foam; iv) conventional polyurethane foam; v) HR (high resilience) polyurethane foam; or vi) any other polyurethane, polyethylene or polyester Foam.

IV. The Four-Layer Mattress

Figure 2:
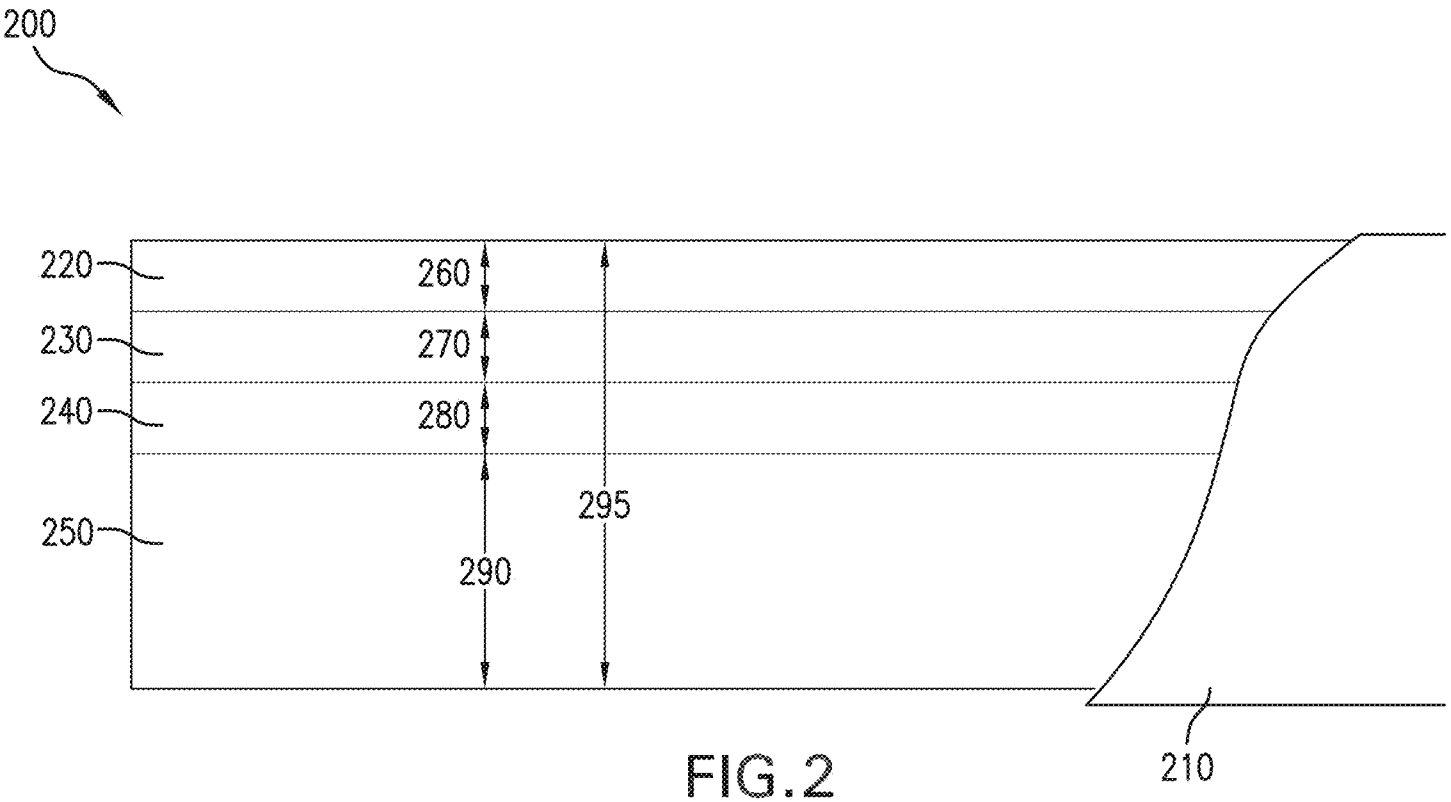
FIG. 2 is a cross-section view of a four-layer mattress in accordance with some embodiments.

Turing to FIG. 2, shown is cross-section of a four-layer mattress 200 with a cover 210. The cross-section of the depth of the mattress 200 includes a first layer 220, a second layer 230, a third layer 240 and a fourth layer 250.

The total depth 295 of the mattress 200 may range from 1 to 22 inches. The first layer depth 260 of the mattress 200 may range from 0.25 to 5 inches. The second layer depth 270 of the mattress may range from 0.25 inches to 5 inches. The third layer depth 280 of the mattress may range from 0.25 to 5 inches. The fourth layer depth 290 of the mattress may range from 0.25 to 12 inches.

The first layer 220 may be latex or latex-like foam. The second layer 230, third layer 240 and fourth layer 250 may be any of the following: i) latex foam; ii) latex-like foam; iii) polyurethane visco-elastic "memory" foam; iv) conventional polyurethane foam; v) HR (high resilience) polyurethane foam; or vi) any other polyurethane, polyethylene or polyester foam. In one embodiment, at least one of the second layer 230, third layer 240 and fourth layer 250 is memory foam. In one embodiment, at least one upper layer has a SF higher than a layer below that upper layer.

V. The Five-Layer Mattress

Figure 3:
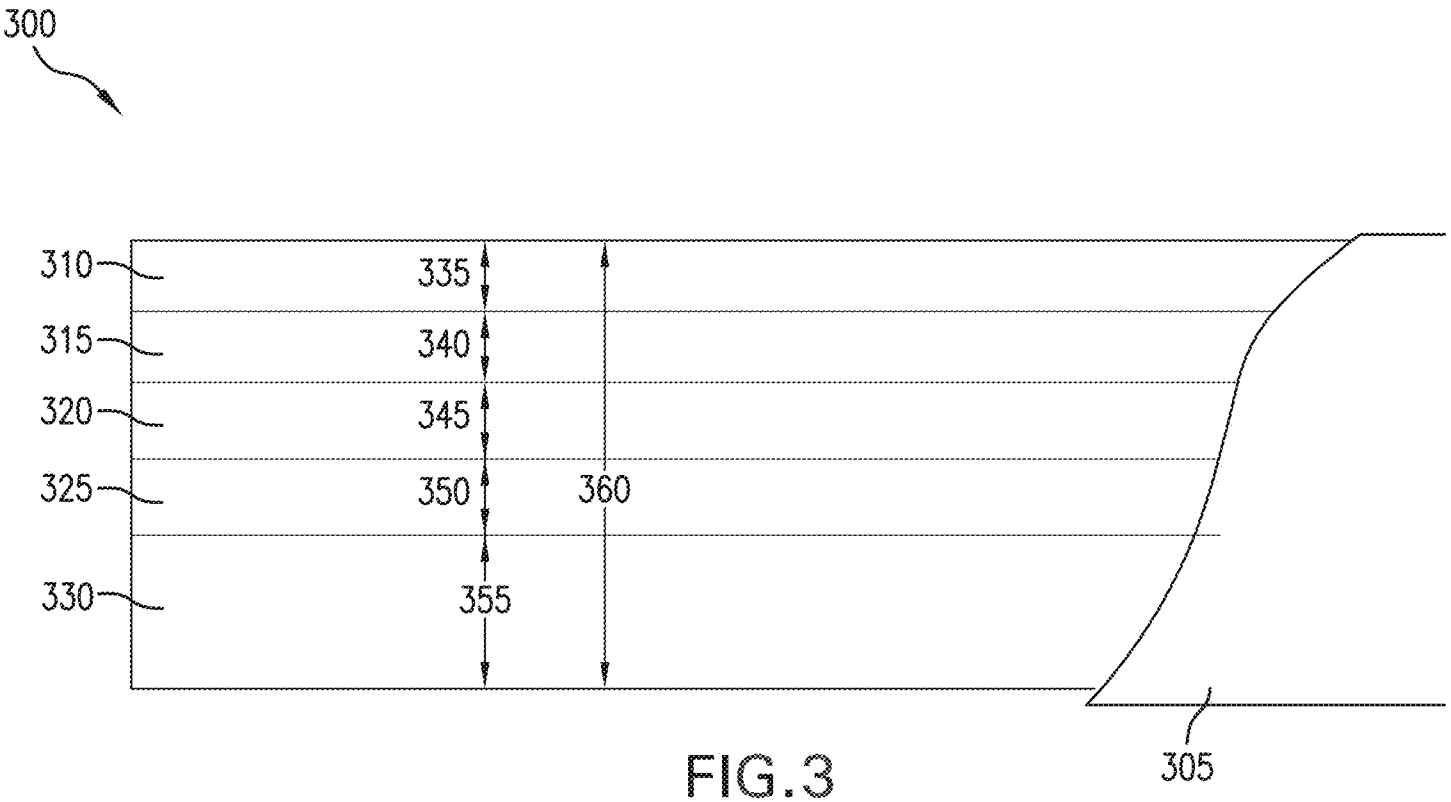
FIG. 3 is a cross-section view of a five-layer mattress in accordance with some embodiments.

Turing to FIG. 3, shown is cross-section of a five-layer mattress 300 with a cover 305. The cross-section of the depth of the mattress 300 includes a first layer 310, a second layer 315, a third layer 320, a fourth layer 325 and a fifth layer 330.

TABLE 3

| | Target | Tolerance | Unit | Test Method | Potential Range | Unit |
|---|---|---|---|---|---|---|
| Density | 1.8 | ±0.1 | Pcf | n/a | 1 to 4 | pcf |
| 25% IFD | 32 | ±3 | Lb | ASTM D3574-11 Test $B_1$ | 15 to 50 | lb |
| Airflow | >4 | minimum | Cfm | ASTM D3574-11 Test G | >2 | cfm |
| Recovery | <0.5 | maximum | Seconds | ASTM D3574-11 Test M | <1 | seconds |
| Rebound | 50 | ±5 | % | ASTM D3574-11 Test H | >40 | % |
| Support Factor | 1.9 | ±0.1 | n/a | ASTM D3574-11 Test $B_1$ | 1.5 to 3.5 | n/a |
| Tg | | | n/a | | | |

The total depth 360 of the mattress 300 may range from 1.25 to 22 inches. The first layer depth 335 of the mattress 300 may range from 0.25 to 5 inches. The second layer depth 340 of the mattress may range from 0.25 inches to 5 inches. The third layer depth 345 of the mattress may range from 0.25 to 5 inches. The fourth layer depth 350 of the mattress may range from 0.25 to 5 inches. The fifth layer depth 355 of the mattress may range from 0.25 to 12 inches.

The first layer 310 may be latex or latex-like foam. The second layer 315, third layer 320, fourth layer 325 and fifth layer 330 may be any of the following: i) latex foam; ii) latex-like foam; iii) polyurethane visco-elastic "memory" foam; iv) conventional polyurethane foam; v) HR (high resilience) polyurethane foam; or vi) any other polyurethane, polyethylene or polyester Foam. In one embodiment, at least one of the second layer 315, third layer 320, fourth layer 325 and fifth layer 330 is memory foam. In one embodiment, at least one upper layer has a SF higher than a layer below that upper layer.

VI. Mattress Transportation

Moving a mattress is a cumbersome task. For example, queen-sized mattresses can weigh up to 100 pounds, and are typically floppy with poor affordance for carrying. They are difficult to get through doorways, down stairs and into cars. As such, many people will discard mattresses when they move because the burdens and costs of moving a mattress are too great.

Figure 4A:
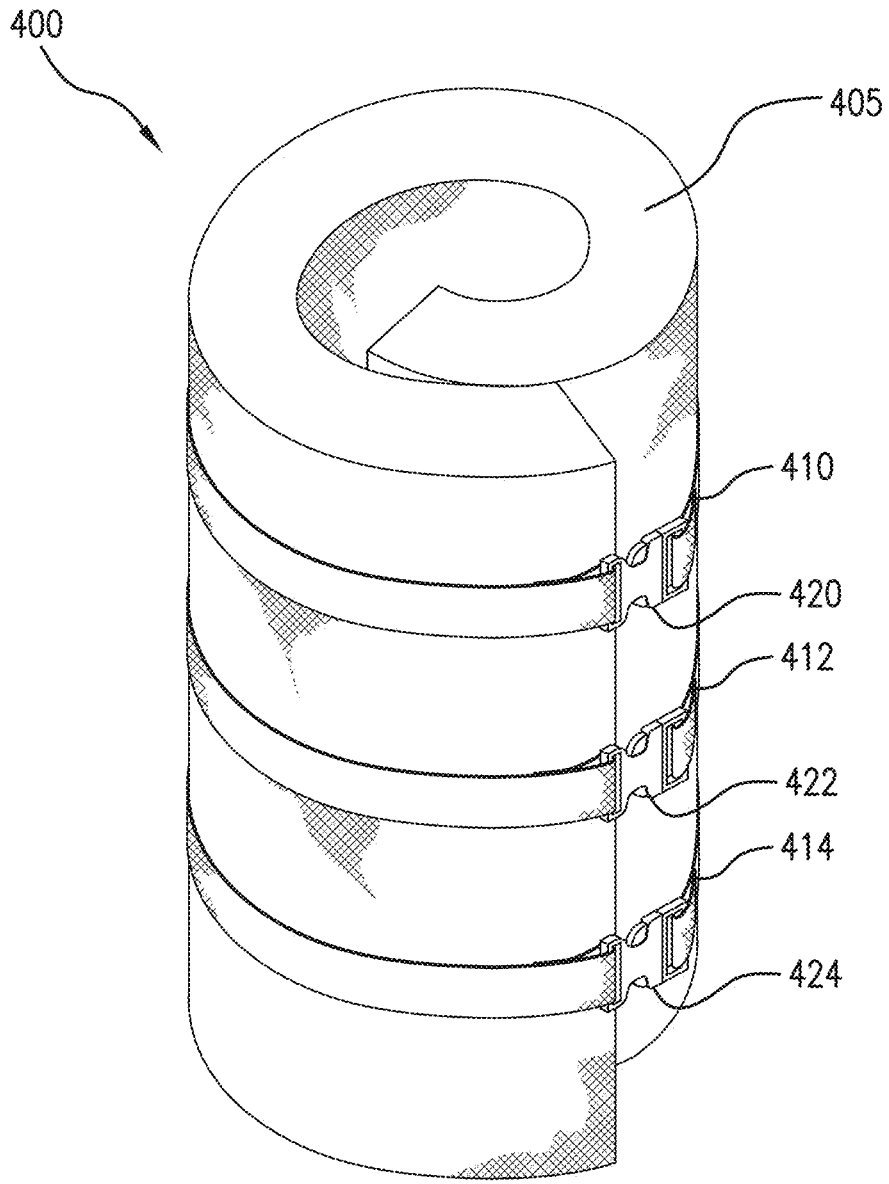
FIGS. 4A and 4B are perspective views of a rolled-up mattress in accordance with some embodiments.

Turing to FIG. 4A, shown is a mattress system 400 with two features that facilitate moving so that mattresses are not discarded and have greater long-term value to their owner. The mattress body 405 incorporates straps 410, 412, 414 integrated into the design that hold the mattress in an easily transportable shape once rolled up or folded. The straps may be webbing, string or any other material with high tensile strength. The straps may tie, have buckles or incorporate any other fasteners 420, 422, 424 that enable the straps to hold the mattress together. The user manually rolls up and/or folds the mattress, and the straps are located in a convenient place such that once rolled, the mattress may easily be strapped together. By integrating the straps, the rolling and strapping process is easier and ensures that all users have the proper materials at hand to roll the mattress for transport.

Figure 4B:
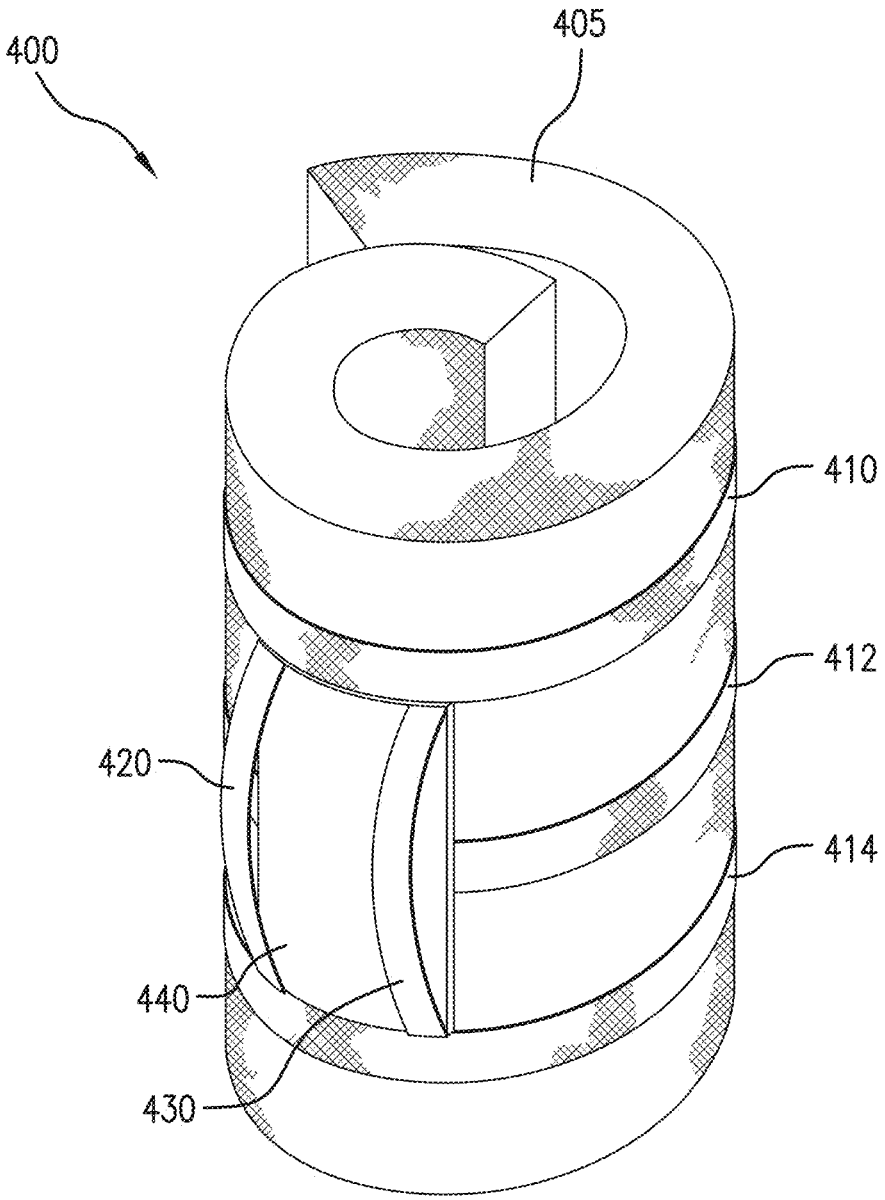

Turing to FIG. 4B, shown is another view of the mattress system 400. In addition to the straps 410, 412, 44, the mattress body 405 has integrated backpack, shoulder and/or hand straps 420, 430 installed via a securing mechanism 440 that allow the mattress body 405 to be readily carried by one or more people on their shoulders and/or back. This greatly facilitates portability, increasing the odds that an owner will take their mattress with them to their new home and be able to do so with minimal hassle.

In another embodiment, the cinch straps and carrying straps are part of a separate "wrap" or bag rather than integrated into the mattress.

VII. Integrated Mattress Washable Pad

Mattresses are expensive investments that often become stained with sweat and/or other bodily fluids. Even when used with sheets and a mattress pad (a separately-purchased cover that is used to protect the mattress), mattresses become stained. In nearly all cases, the cover of the mattress itself is not washable other than through spot cleaning. A limited number of mattresses (often futon-style) may have a cover that completely zips off and can be laundered, but this is often a cumbersome process because it requires a lot of manipulation of the heavy mattress. Staining of mattresses limits their resale value and can prevent people from giving a mattress to friends when they decide to move town or upgrade to a different mattress.

Figure 5A:
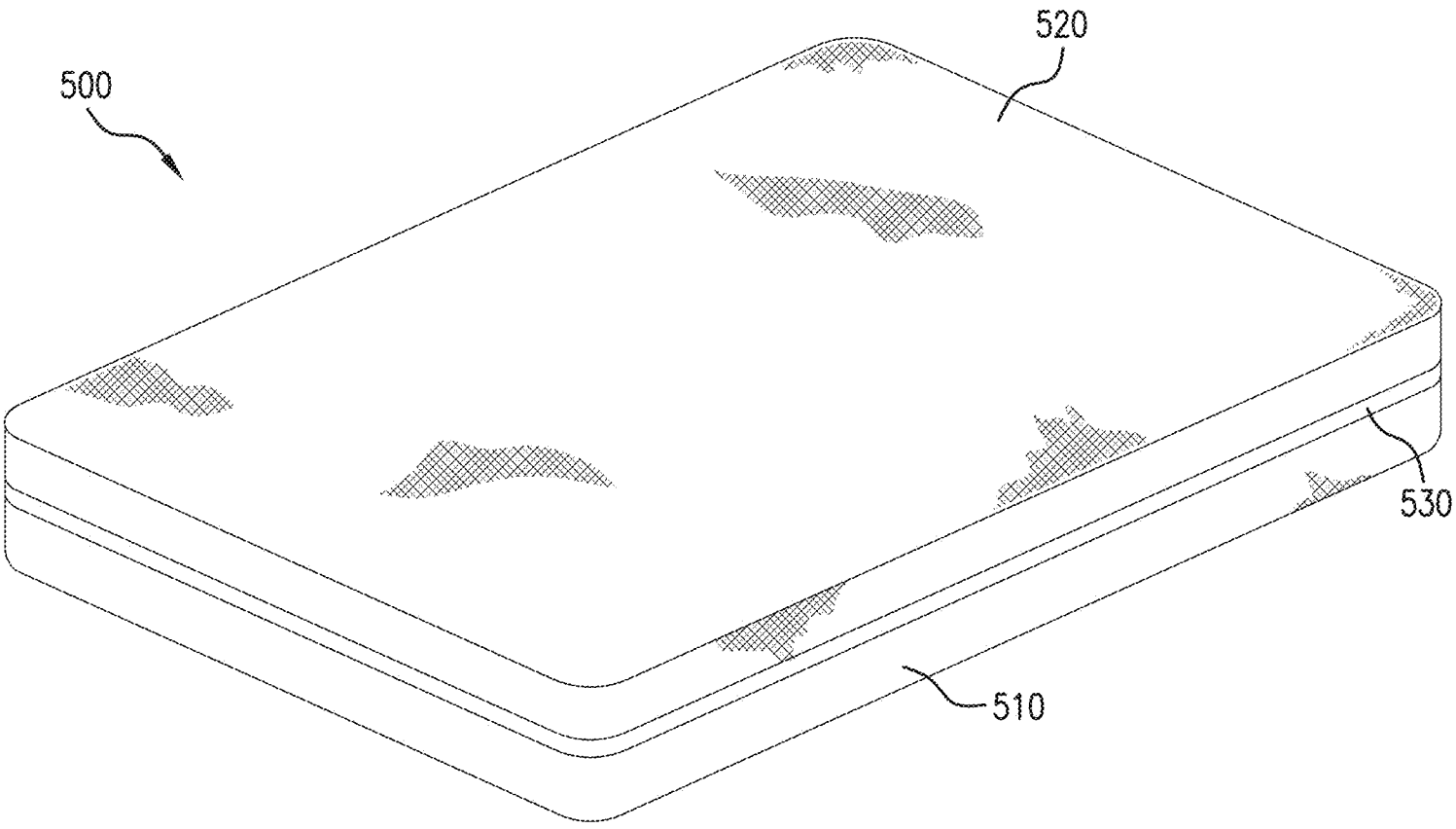
FIGS. 5A and 5B are perspective views of a mattress with a removable cover in accordance with some embodiments.

Turing to FIG. 5A, shown is a mattress system 500 including a mattress body 510 and of a removable section of a detachable mattress cover 520 that protects the primary mattress cover from stains and that can be washed or replaced with a new one in order to "refresh" the mattress. In this embodiment, the mattress cover 520 covers the entire top of the mattress body 510 and is secured to the mattress body 510 by a securing mechanism 530. It may be reversible to quickly provide a clean top surface, and it may have different colors from the mattress body 510 in order to better hide stains.

The securing mechanism 530 may be secured at approximately the same depth all around the mattress body 510 and may consist of hook and loop fasteners, zippers, buttons, snaps, ties or any combination thereof.

Figure 5B:
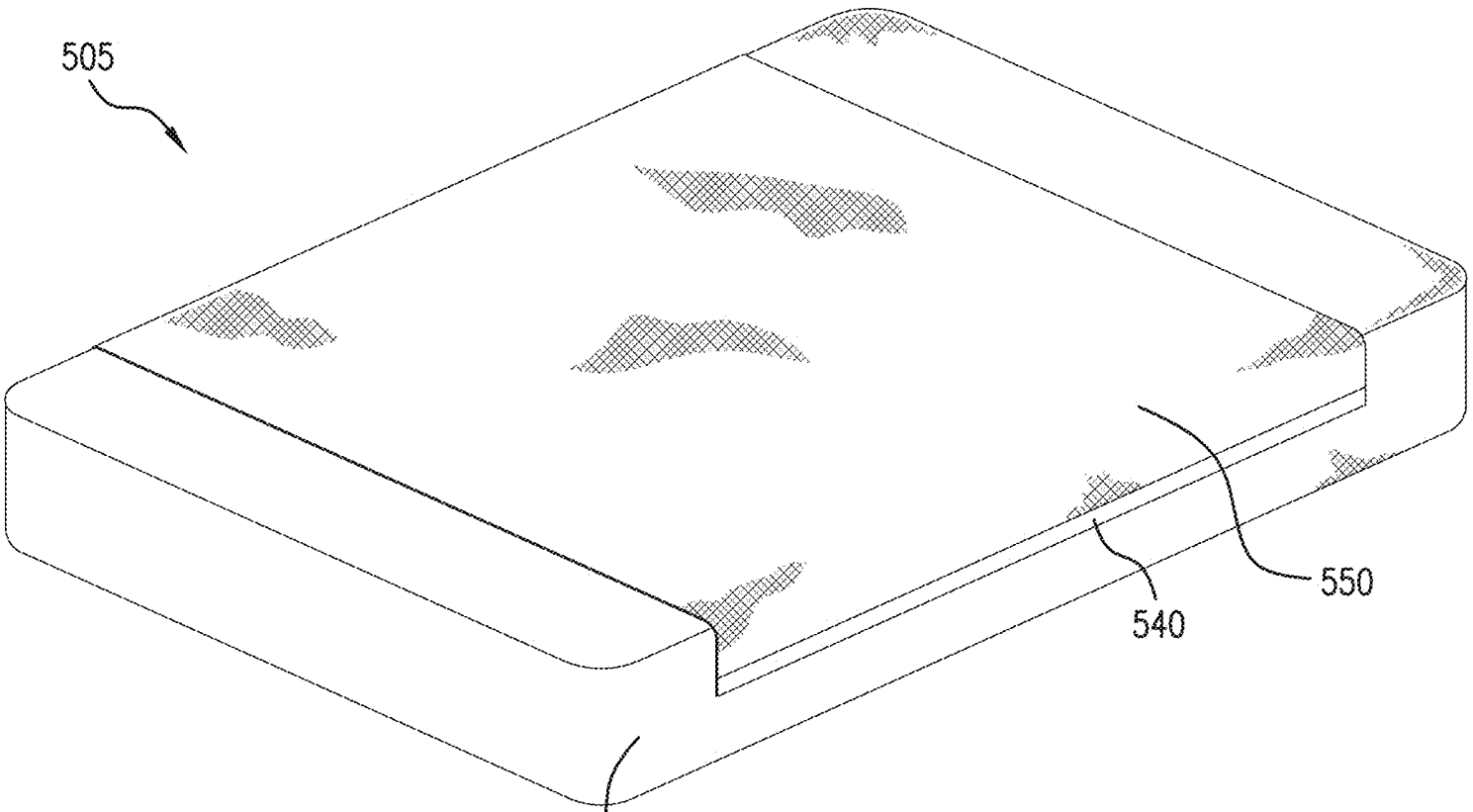

Turing to FIG. 5B, shown is a mattress system 505 including a mattress body 510 and a removable section of a detachable mattress cover 550 that protects the primary mattress cover from stains and that can be washed or replaced with a new one in order to "refresh" the mattress. In this embodiment, the mattress cover 550 covers a portion of the top of the mattress body 510 and is secured to the mattress body 510 by a securing mechanism 540. The mattress cover 550 may be located in the area most likely to absorb bodily fluids (in the region from the head to the upper thigh). It may cover just the top of the mattress body 510 so it can be easily removed and laundered. It may be reversible to quickly provide a clean top surface, and it may have different colors from the primary mattress in order to better hide stains.

The securing mechanism 540 may be secured at approximately the same depth around the mattress body 510 to best secure the mattress cover 550 The securing mechanism 540 may consist of hook and loop fasteners, zippers, buttons, snaps, ties or any combination thereof.

Figures 6A, 6B:
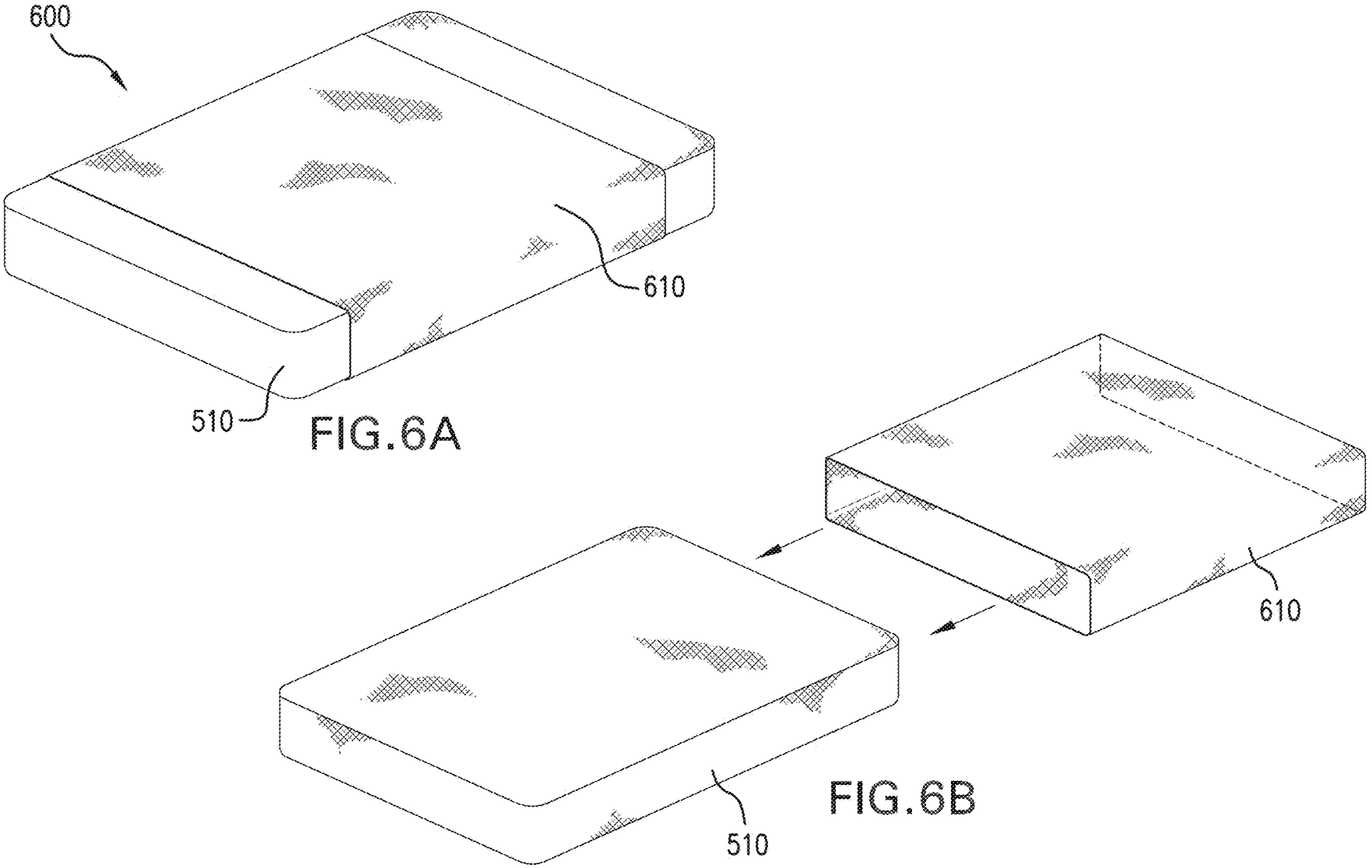
FIGS. 6A and 6B are perspective views of a mattress with a removable cover in accordance with some embodiments.

Turing to FIGS. 6A and 6B, shown is a mattress system 600 with a removable mattress pad 610 that surrounds a portion of the mattress body 510. The mattress pad 610 may be placed in the area most likely to absorb bodily fluids (in the region from the head to the upper thigh). It may cover just the top of the mattress body 510 so it can be easily removed and laundered. It may be reversible to quickly provide a clean top surface, and it may have different colors from the primary mattress in order to better hide stains.

Figure 7B:
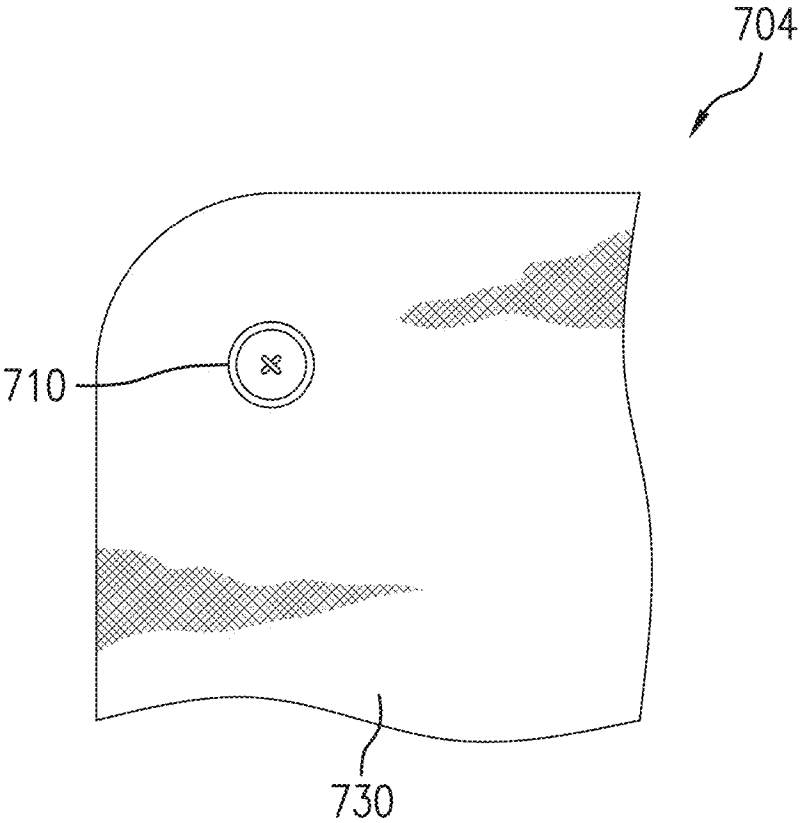
FIGS. 7A, 7B and 7C are perspective views of a mattress with a button-down cover in accordance with some embodiments.
Figure 7A:
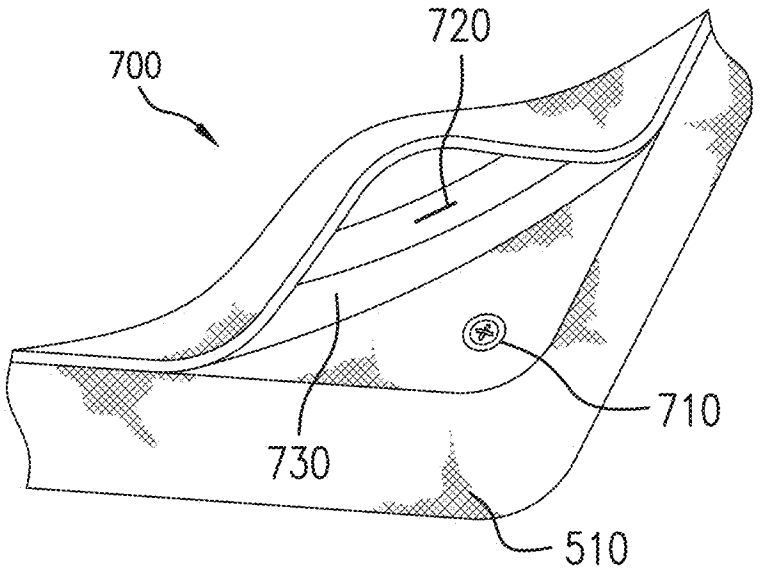
Figure 7C:
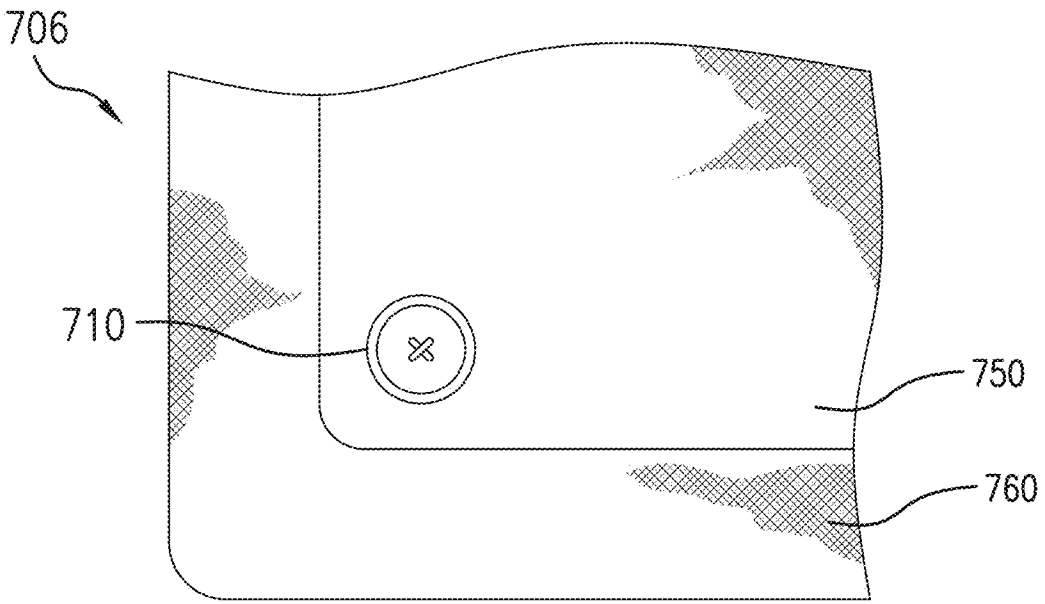

Turing to FIG. 7A, shown is a mattress system 700 with a removable mattress pad 730. It is secured to the mattress body 510 via a button 710 attached to the mattress body 510 and a button hole 720 installed in the mattress pad 730. Turning to FIG. 7B, shown is a mattress system 704 where the mattress pad 730 is attached to the mattress body (not shown) by means of the button 710 attached to the mattress. Turning to FIG. 7C, shown is a mattress system 706 where the mattress pad 750 is attached to a portion of the mattress body 760 via a button 710 attached to the mattress body 760. The mattress pads 730, 750 may be reversible to quickly provide a clean top surface, and may have different colors from the primary mattress in order to better hide stains.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An apparatus comprising:

a mattress, the mattress comprising a first horizontal layer, a second horizontal layer positioned below the first horizontal layer, and a third horizontal layer positioned below the second horizontal layer;

wherein the first horizontal layer comprises a foam layer selected from the group consisting of latex foam and latex-like foam;

wherein the latex-like foam comprises at least one of pol urethane pol ethylene, non-natural resins, and non-styrene butadiene rubber resins;

wherein the second horizontal layer comprises memory foam;

wherein the third horizontal layer comprises polyurethane foam;

wherein the first horizontal layer has a rebound of at least 40% wherein the first horizontal layer has an airflow of at least 2 cubic feet per minute; and wherein the first horizontal layer has a support factor of at least 2.

2. The apparatus as in claim 1, wherein the first horizontal layer has a 25% IFD of between 6 to 18 pounds.

3. The apparatus as in claim 1, wherein the first horizontal layer has a density of between 2 to 4 pounds per cubic foot.

4. An apparatus comprising:

a mattress, the mattress comprising a first horizontal layer, a second horizontal layer positioned below the first horizontal layer, and a third horizontal layer positioned below the second horizontal layer;

wherein the first horizontal layer comprises a foam layer selected from the group consisting of latex foam and latex-like foam;

wherein the latex-like foam comprises at least one of polyurethane, polyethylene, non-natural resins, and non-styrene butadiene rubber resins;

wherein the second horizontal layer comprises memory foam;

wherein the third horizontal layer comprises polyurethane foam;

wherein the first horizontal layer has a rebound of at least 40%;

wherein the first horizontal layer has an airflow of at least 2 cubic feet per minute; and wherein the first horizontal layer has a 25% IFD of between 6 to 18 pounds.

5. The apparatus as in claim 4, wherein the first horizontal layer has a density of between 2 to 4 pounds per cubic foot.

6. An apparatus comprising:

a mattress, the mattress comprising a first horizontal laver, a second horizontal layer positioned below the first horizontal layer, and a third horizontal layer positioned below the second horizontal layer;

wherein the first horizontal layer comprises a foam layer selected from the group consisting of latex foam and latex-like foam;

wherein the latex-like foam comprises at least one of polyurethane, polyethylene, non-natural resins, and non-styrene butadiene rubber resins;

wherein the second horizontal layer comprises memory foam;

wherein the third horizontal layer comprises polyurethane foam;

wherein the first horizontal layer has a rebound of at least 40%;

wherein the first horizontal layer has an airflow of at least 2 cubic feet per minute; and wherein the first horizontal layer has a density of between 2 to 4 pounds per cubic foot.

* * * * *